United States Patent [19]

Nakajima et al.

[11] Patent Number: 4,976,592

[45] Date of Patent: Dec. 11, 1990

[54] VARIABLE CAPACITY VANE COMPRESSOR

[75] Inventors: Nobuyuki Nakajima; Kenichi Inomata; Shigeru Okada; Kazuo Eitai, all of Konan, Japan

[73] Assignee: Diesel Kiki Co., Ltd., Tokyo, Japan

[21] Appl. No.: 394,118

[22] Filed: Aug. 15, 1989

Related U.S. Application Data

[63] Continuation-in-part of Ser. No. 120,152, Nov. 12, 1987, Pat. No. 4,867,651.

[30] Foreign Application Priority Data

Feb. 20, 1987 [JP] Japan ..... 62-037646

[51] Int. Cl.[5] ..... F04B 49/00

[52] U.S. Cl. ..... 417/295; 417/310

[58] Field of Search ..... 417/295, 310

[56] References Cited

U.S. PATENT DOCUMENTS 3,515,496 6/1970 Eddy .

4,744,732 5/1988 Nakajima et al. .

FOREIGN PATENT DOCUMENTS 62-129593 6/1987 Japan .

*Primary Examiner*—Douglas Hart

*Attorney, Agent, or Firm*—Frishauf, Holtz, Goodman & Woodward

[57] ABSTRACT

A variable capacity vane compressor has an annular control element angularly displaceably received within an annular recess formed in one of side blocks defining a cylinder. The control element is angularly displaced in response to a difference in pressure between first and second pressure chambers formed in the one side block and communicating with a zone under lower pressure and a zone under higher pressure, respectively, and to the biasing force of a biasing member, thereby varying the opening angle of at least one second inlet port formed in the one side block and hence controlling the capacity of the compressor. A positioning device is provided at a radially inner portion of the control element to radially position the control element in place within the annular recess of the one side block with reference to the radially inner portion of the control element, thus relieving the hysteresis between angular displacement of the control element in one circumferential directions and that in the opposite direction. At least one oil groove is formed in the inner peripheral surface of the control element to guide lubricating oil for lubricating the same element and its associated sliding parts to a sufficient degree to further reduce the hysteresis.

10 Claims, 11 Drawing Sheets

VARIABLE CAPACITY VANE COMPRESSOR

This is a continuation-in-part of Ser. No. 120,152, filed Nov. 12, 1987, whch is now U.S. Pat. No. 4,867,651 granted Sep. 19, 1989.

BACKGROUND OF THE INVENTION

This invention relates to variable capacity vane compressors which are adapted for use as refrigerant compressors of air conditioners for automotive vehicles, and more particularly to vane compressors of this kind in which the timing of commencement of compression is varied to thereby control the capacity of the compressor.

A variable capacity vane compressor has conventionally been proposed e.g. by Japanese Provisional Patent Publication (Kokai) No. 62-129593 assigned to the same assignee of the present application, which is adapted for compressing refrigerant of an air conditioner for automotive vehicles.

The above conventional compressor comprises: a cylinder formed of a cam ring and a pair of front and rear side blocks closing opposite ends of the cam ring, one of the front and rear side blocks having at least one first inlet port formed therein; a rotor rotatably received within the cylinder; a plurality of vanes radially slidably fitted in respective slits formed in the rotor; a housing accommodating the cylinder and defining a suction chamber and a discharge pressure chamber therein; wherein compression chambers are defined between the cylinder, the rotor and adjacent ones of the vanes and vary in volume with rotation of the rotor for effecting suction of a compression medium from the suction chamber into the compression chambers through the at least one first inlet port, and compression and discharge of the compression medium; at least one second inlet port formed in the one of the front and rear side blocks which has the at least one first inlet port formed therein, the at least one second inlet port being located adjacent a corresponding one of the at least one first inlet port, and communicating the suction chamber with at least one of the compression chambers which is on a suction stroke; a pressure chamber formed in the one of the front and rear side blocks having the at least one first inlet port formed therein, and communicating with a zone under lower pressure and a zone under higher pressure; a control element for controlling the opening angle of the at least one second inlet port, the control element having a pressure receiving portion slidably fitted in the pressure chamber and dividing the pressure chamber into a first pressure chamber communicating with the zone under lower pressure and a second pressure chamber communicating with both the zone under lower pressure and the zone under higher pressure; the control element being angularly displaceable in response to a difference in pressure between the first and second chambers for causing the control element to vary the opening angle of the at least one second inlet port, to thereby cause a change in the timing of commencement of the compression of the compression medium and hence vary the capacity of the compressor; a biasing member for biasing the control element in a direction of increasing the opening angle of the at least one second inlet port; a low-pressure communication passage communicating the second pressure chamber with the zone under lower pressure; a high-pressure communication passage communicating the second pressure chamber with the zone under higher pressure; and valve means for selectively opening and closing the low-pressure communication passage and the high-pressure communication passage, the valve means being disposed to close the low-pressure communication passage and simultaneously open the high-pressure communication passage or to open the high-pressure passage after closing the low-pressure passage, when pressure within the zone under lower pressure exceeds a predetermined value, and to open the low-pressure communication passage and simultaneously effect one of closing and reduction of the opening area of the high-pressure communication passage or to open the low-pressure passage after closing the high-pressure passage when the pressure within the zone under lower pressure is below the predetermined value.

However, according to the conventional vane compressor, the biasing member is formed by a coiled spring, for example, which has a coiled body thereof fitted around a hub projecting integrally from the one of the side blocks at one end face remote from the rotor, with one end thereof engaged with the control element and another end thereof with the hub, respectively. With such arrangement, the coiled body of the coiled spring can have loops thereof brought into contact with each other, or can be brought into contact with the outer peripheral surface of the hub since the ends of the coiled spring are loosely supported by the control element and the hub of the one side block, thus undesirably causing a frictional force acting upon the control element. This frictional force acting upon the control element possibly results in a hysteresis in the angular displacement of the control element, thereby making it difficult to accurately control the control element and hence the capacity of the compressor.

Furthermore, in the conventional vane compressor, as shown in FIG. 1, the control element A is received and positioned in place within an annular recess B1 formed in the side block B with reference to the outer peripheral surface thereof, i.e., in such a manner that a part A1 of the outer peripheral surface is kept in contact with the inner peripheral surface of the annular recess B1 of the side block B by the urging force of the coiled spring C. With such arrangement, the distance between the diametrical center or axis of the control element A and a point where the outer peripheral surface of the control element A is in contact with the inner peripheral surface of the annular recess B1 is so long that a large amount of frictional torque is caused to act upon the control element A, which results in a hysteresis in the angular displacement of the control element A, thereby making it difficult to accurately control the control element A and hence the capacity of the compressor.

In addition, in the conventional vane compressor, proper consideration was not given to lubrication of the control element A as a rotating member, particularly, lubrication of points of the control element A at which it is radially or axially positioned in place, such as the outer peripheral surface of the control element A and the inner peripheral surface of the annular recess B1 as well as opposed end faces of the control element A and the rotor. Therefore, the control element A also undergoes large frictional torque due to insufficient lubrication of the above points, which further increases the above-mentioned hysteresis.

SUMMARY OF THE INVENTION

It is an object of the invention to provide a variable capacity vane compressor in which frictional torque, caused by contact of the control element with a component part adjacent thereto to act upon the control element, is reduced to relieve the hysyeresis in the angular displacement of the control element, thereby improving the controllability of the capacity of the compressor.

A further object of the invention is to provide a variable capacity compressor, in which the control element is lubricated to a sufficient degree to further reduce the hysteresis.

According to the present invention, there is provided a variable capacity vane compressor comprising:

a cylinder formed of a cam ring and a pair of front and rear side blocks closing opposite ends of said cam ring, one of the front and rear side blocks having at least one first inlet port and an annular recess formed therein;

a rotor rotatably received within the cylinder;

a plurality of vanes radially slidably fitted in respective slits formed in said rotor;

a housing defining a suction chamber and a discharge pressure chamber therein;

wherein compression chambers are defined between the cylinder, the rotor and adjacent ones of the vanes vary in volume with rotation of the rotor for effecting suction of a compression medium from the suction chamber into the compression chambers through the at least one first inlet port, and compression and discharge of the compression medium;

at least one second inlet port formed in the one of the front and rear side blocks which has the at least one first inlet port formed therein, the at least one second inlet port being located adjacent a corresponding one of the at least one first inlet port, and communicating the suction chamber with at least one of the compression chambers which is on a suction stroke;

a pressure chamber formed in the one of the front and rear side blocks, and communicating with a zone under lower pressure and a zone under higher pressure;

an annular control element angularly displaceably received within the annular recess of the one of the front and rear side blocks;

the control element having a pressure receiving portion slidably received within the pressure chamber and dividing the pressure chamber into a first pressure chamber communicating with the zone under low pressure and a second pressure chamber communicating with the zone under high pressure;

biasing means engaging with the control element and urging same in a direction of increasing the opening angle of the at least one second inlet port;

the control means being angularly displaceable in response to a difference in pressure between the first and second pressure chambers and the biasing force of the biasing means to vary the opening angle of the at least one second inlet port, to thereby cause a change in the timing of commencement of the compression of the compression medium and hence vary the capacity of the compressor;

positioning means provided at a radially inner portion of the control element and radially supporting the control element at the whole circumference thereof to radially position the control element in place within the annular recess of the one of the front and rear side blocks with reference to the radially inner portion of the control element;

a rotary shaft extending through the rotor along an axis thereof for rotatively driving same;

the control element having a central bore formed therethrough and fitted on the rotary shaft;

the positioning means comprising an annular projection formed on an inner peripheral surface of the central bore and held in contact with the rotary shaft; and at least one oil groove formed in the inner peripheral surface of the central bore, the at least one oil groove having one end thereof opening in an end face of the control element and the other end thereof opening in the other end face of said control element.

The above and other objects, features and advantages of the invention will be more apparent from the ensuing detailed description taken in conjunction with the accompanying drawings.

Figure 9:
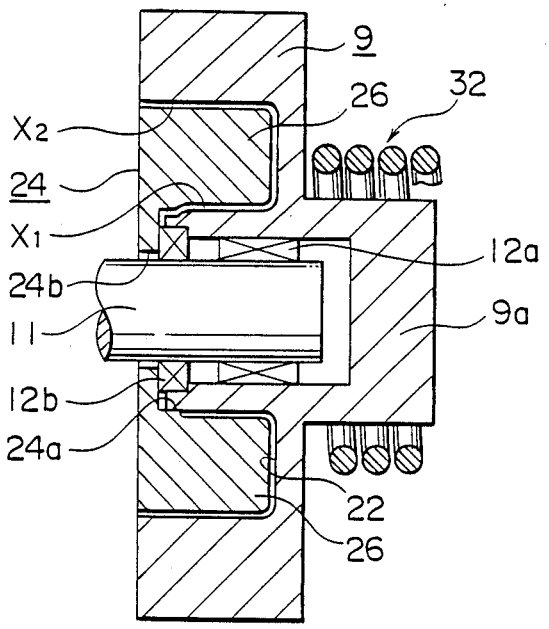
FIG. 9 is a fragmentary longitudinal cross-sectional view showing an essential part of the vane compressor of FIG. 2.
Figure 14:
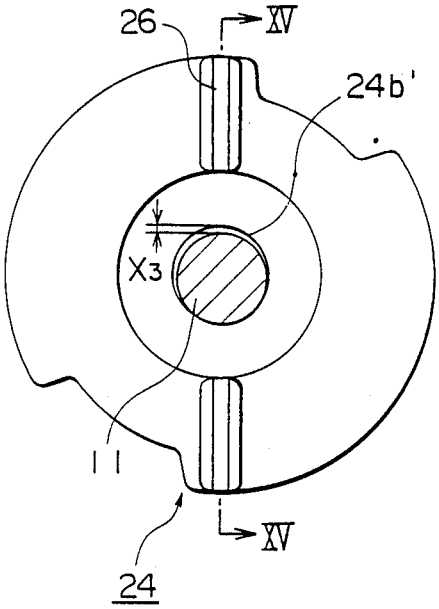
FIG. 14 is a rear view of a control element in FIG. 13, showing a gap between the control element and the rotary shaft.
Figure 15A:
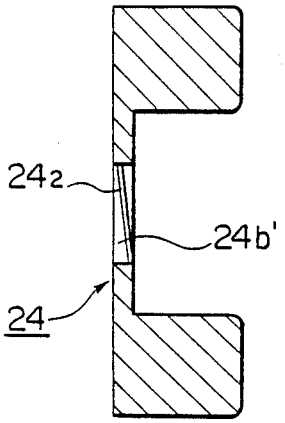
Figure 15B:
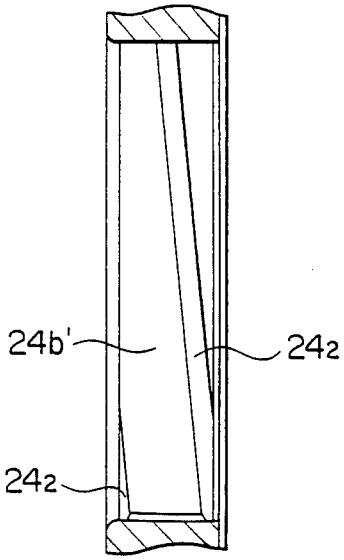
Figure 16:
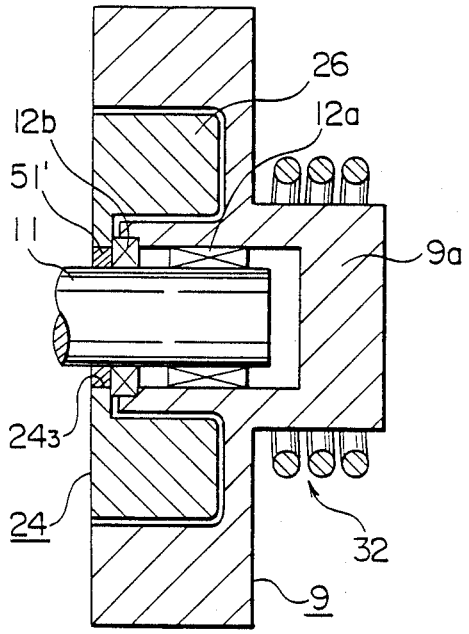
Figure 17:
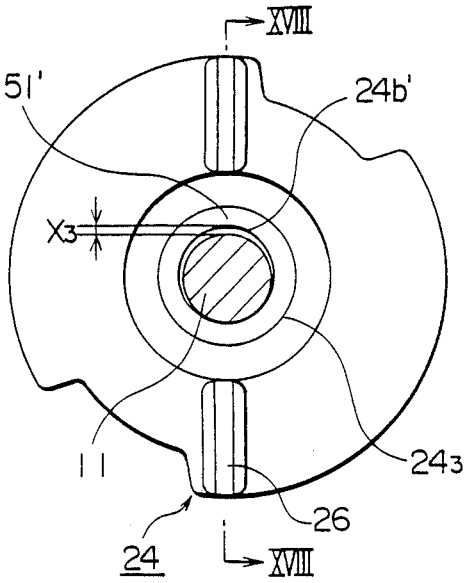
Figure 18:
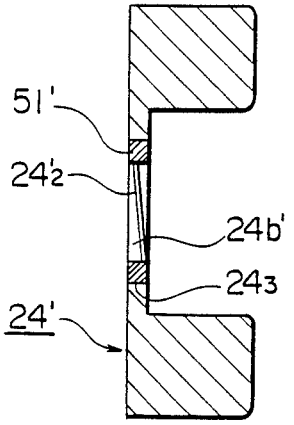

(a) of FIG. 15 is a longitudinal cross-sectional view of the control element taken along line XV—XV in FIG. 14, and (b) is an enlarged view of a central bore portion thereof;

FIG. 16 is a view similar to FIG. 9, showing a sixth embodiment according to the present invention;

FIG. 17 is a rear view of a control element in FIG. 16, showing a gap between the control element and the rotary shaft; and FIG. 18 is a longitudinal cross-sectional view of the control element taken along line XVIII—XVIII in FIG. 17.

DETAILED DECRIPTION

The invention will now be described in detail with reference to the drawings showing embodiments thereof.

Figure 1:
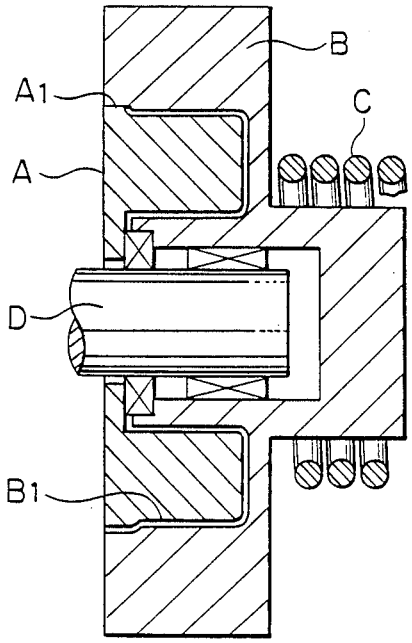
FIG. 1 PRIOR ART
FIG. 1 is a fragmentary longitudinal cross-sectional view showing a control element and its peripheral parts of a conventional variable capacity vane compressor.
Figure 2:
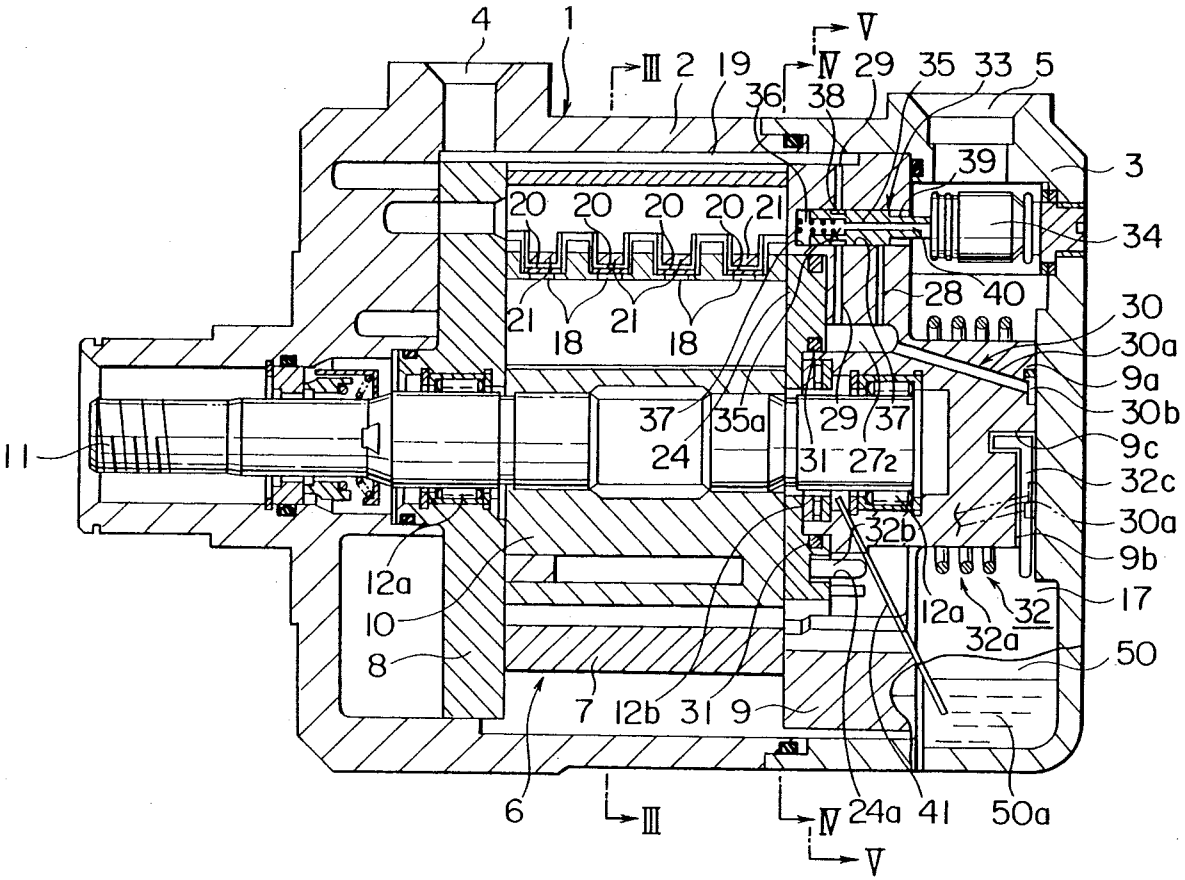
FIG. 2 is a longitudinal cross-sectional view of a variable capacity vane compressor according to a first embodiment of the present invention.

FIGS. 2 through 9 show a variable capacity vane compressor according to a first embodiment of the invention. FIG. 2 shows a vane compressor according to the present invention, wherein a housing 1 comprises a cylindrical casing 2 with an open end, and a rear head 3, which is fastened to the casing 2 by means of bolts, not shown, in a manner closing the open end of the casing 2. A discharge port 4, through which a refrigerant gas is to be discharged as a thermal medium, is formed in an upper wall of the casing 2 at a front end thereof, and a suction port 5, through which the refrigerant gas is to be drawn into the compressor, is formed in an upper portion of the rear head 3. The discharge port 4 and the suction port 5 communicate, respectively, with a discharge pressure chamber and a suction chamber, both hereinafter referred to.

A pump body 6 is housed in the housing 1. The pump body 6 is composed mainly of a cylinder formed by a cam ring 7, and a front side block 8 and a rear side block 9 closing open opposite ends of the cam ring 7, a cylindrical rotor 10 rotatably received within the cam ring 7, and a rotary shaft 11 which is connected to an engine, not shown, of a vehicle or the like, and on which is secured the rotor 10. The rotary shaft 11 is rotatably supported by a pair of radial bearings 12*a*, 12*a* provided in the side blocks 8 and 9, respectively, and a thrust bearing 12*b* provided in the rear side block 9.

Figure 3:
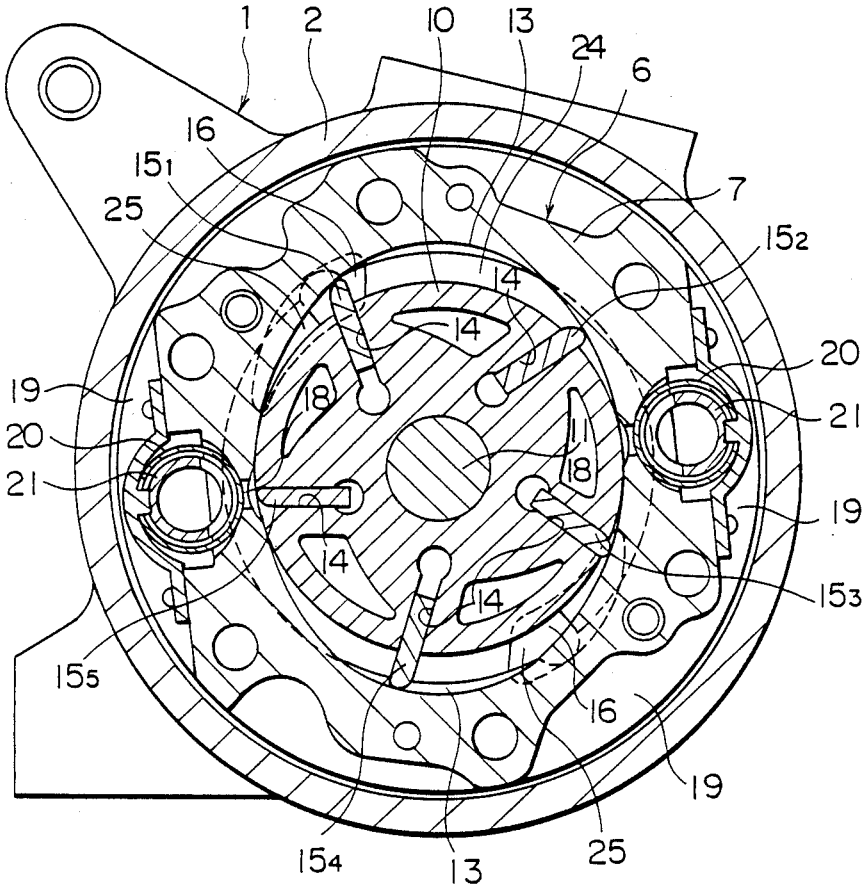
FIG. 3 is a transverse cross-sectional view taken along line III—III of FIG. 2.

The cam ring 7 has an inner peripheral surface with an elliptical cross section, as shown in FIG. 3, and cooperates with the rotor 10 to define therebetween a pair of spaces 13 and 13 at diametrically opposite locations.

The rotor 10 has its outer peripheral surface formed with a plurality of (five in the illustrated embodiment) axial vane slits 14 at circumferentially equal intervals, in each of which a vane $15_1$–$15_5$ is radially slidably fitted.

Figure 4:
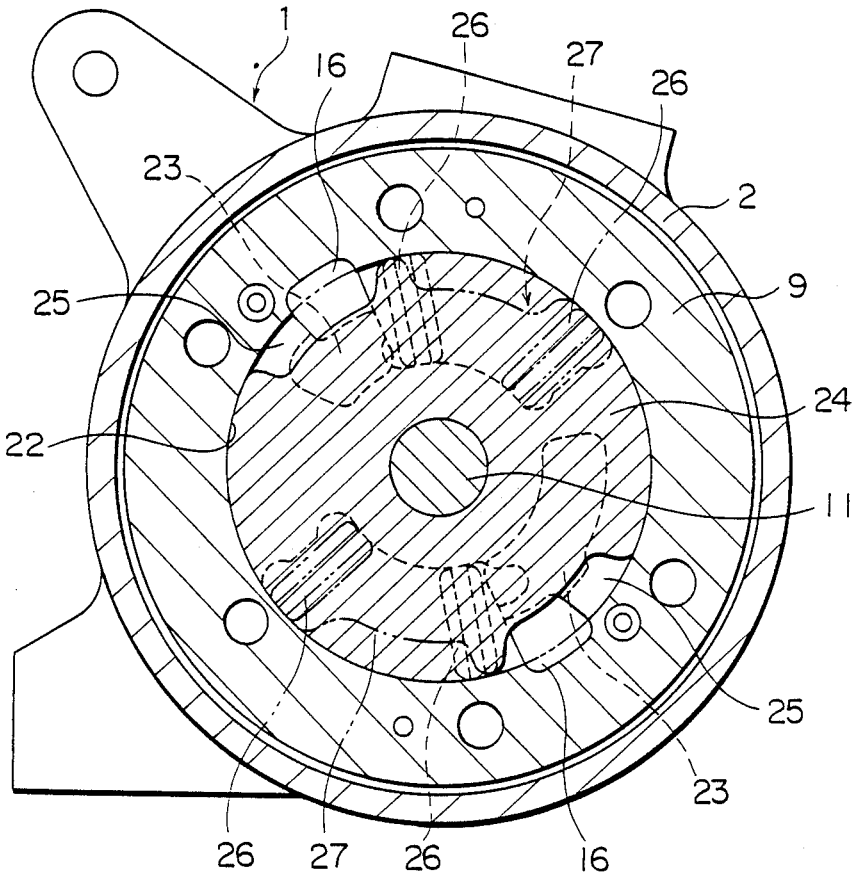
FIG. 4 is a transverse cross-sectional view taken along line IV—IV of FIG. 2.

Refrigerant inlet ports 16 and 16 are formed in the rear side block 9 at diametrically opposite locations as shown in FIGS. 3 and 4. These refrigerant inlet ports 16, 16 are located at such locations that they become closed when the respective compression chambers 13, defined by the adjacent vanes $15_1$–$15_5$, assume the maximum volume. These refrigerant inlet ports 16, 16 axially extend through the rear side block 9 and through which a suction chamber (lower pressure chamber) 17 defined in the rear head 3 by the rear side block 9 and the compression chambers 13 on the suction stroke are communicated with each other.

A plurality of, e.g. five, refrigerant outlet ports 18 are formed through opposite lateral side walls of the cam ring 7 and through which the compression chambers 13 on the compression stroke are communicated with the discharge pressure chamber (higher pressure chamber) 19 defined within the casing 2, as shown in FIGS. 2 and 3. These refrigerant outlet ports 18 are provided with respective discharge valves 20 and valve retainers 21, as shown in FIG. 3.

Figure 5:
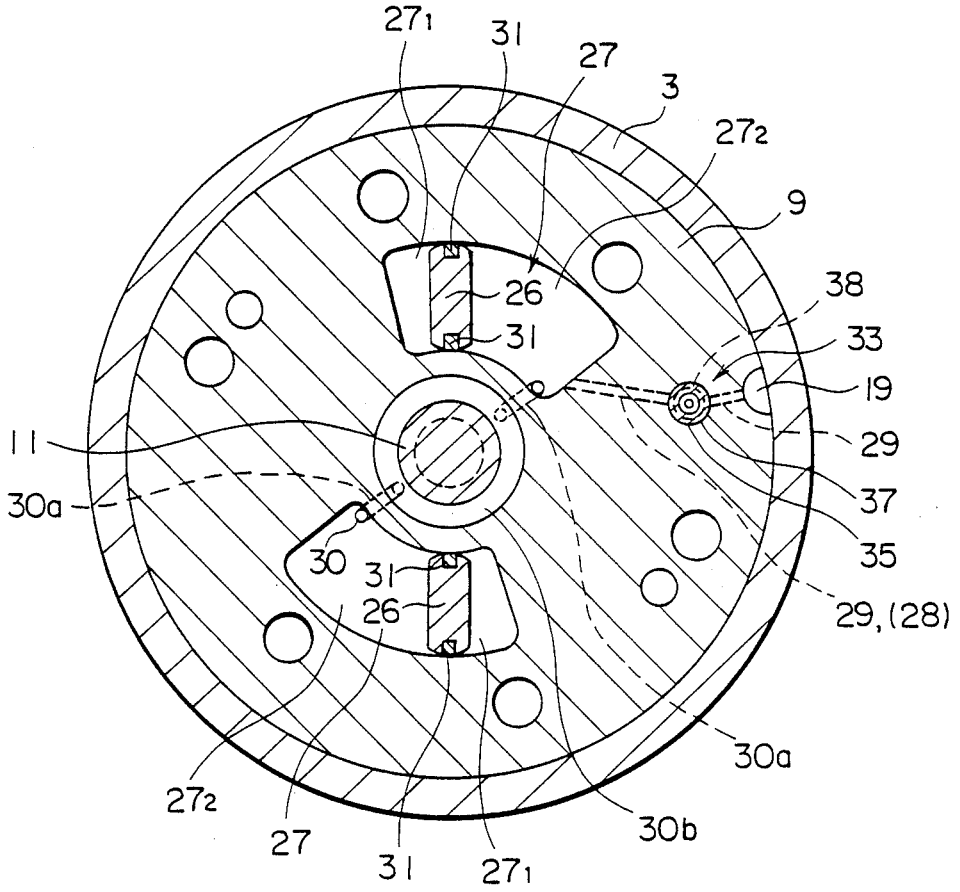
FIG. 5 is a transverse cross-sectional view taken along line V—V of FIG. 2.
Figure 6:
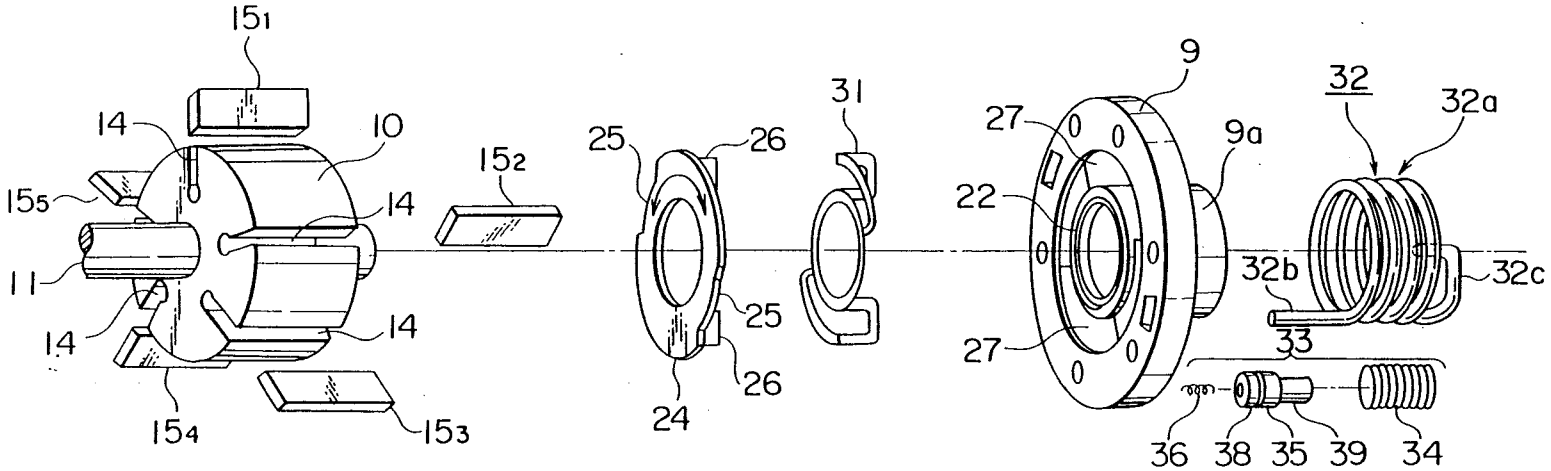
FIG. 6 is an exploded perspective view showing essential parts of the vane compressor of FIG. 2.

The rear side block 9 has an end face facing the rotor 10, in which is formed an annular recess 22, as shown in FIGS. 4 and 6. A pair of second inlet ports 23 and 23 in the form of arcuate openings are formed in the rear side block 9 at diametrically opposite locations and circumferentially extend continuously with the annular recess 22 along its outer periphery, and through which the suction chamber 17 is communicated with the compression chambers 13 on the suction stroke. An annular control element 24 is received in the annular recess 22 for rotation in opposite circumferential directions to control the opening angle of the second inlet ports 23, 23. The control element 24 has its outer peripheral edge formed with a pair of diametrically opposite arcuate cut-out portions 25 and 25, and its one side surface formed integrally with a pair of diametrically opposite partition plates 26 and 26 axially projected therefrom and acting as pressure-receiving elements. The partition plates 26, 26 are slidably received in respective arcuate spaces 27 and 27 which are formed in the rear side block 9 in a manner continuous with the annular recess 22 and circumferentially partially overlapping with the respective second inlet ports 23, 23. The interior of each of the arcuate spaces 27, 27 is divided into first and second pressure chambers $27_1$ and $27_2$ by the associated partition plate 26, as shown in FIG. 5. The first pressure chamber $27_1$ communicates with the suction chamber 17 through the corresponding inlet port 16 and the corresponding second inlet port 23, and the second pressure chamber $27_2$ communicates with the discharge pressure chamber 19 and the suction chamber 17 through a low-pressure passage 28 and a high-pressure passage 29 formed in the rear side block 9. The two chambers $27_2$, $27_2$ are communicated with each other by way of a communication passage 30, as shown in FIGS. 2 and 5. The communication passage 30 comprises a pair of communication channels 30*a*, 30*a* formed in a boss 9*a* projected from a central portion of the rear side block 9 at a side remote from the rotor 10, and an annular space 30*b* defined between a projected end face of the boss 9*a* and an inner end face of the rear head 3. The communication passages 30*a*, 30*a* are arranged symmetrically with respect to the center of the boss 9*a*. Respective ends of the communication passages 30*a*, 30*a* are communicated with the respective second pressure chambers $27_2$, $27_2$, and the other respective ends are communicated with the annular space 30*b*. The low-pressure passage 28 and the high-pressure passage 29 are formed in the rear side block 9, as shown in FIG. 2.

A sealing member 31 of a special configuration is mounted in the control element 24 and disposed along an end face of its central portion and radially opposite end faces of each pressure-receiving protuberance 26, to seal in an airtight manner between the first and second pressure chambers $27_1$ and $27_2$, as shown in FIG. 5, as well as between the inner and outer peripheral surfaces of the control element 24 and those of the annular recess 22 of the rear side block 9, respectively, as shown in FIG. 2.

The control element 24 is elastically urged in such a circumferential direction as to increase the opening angle of the second inlet ports 23, i.e. in the clockwise direction as viewed in FIG. 4, by a coiled spring 32 fitted loosely around a central boss 9*a* of the rear side block 9 axially extending toward the suction chamber 17, with its loops 32*a* axially spaced from each other.

The coiled spring 32 has one end 32*b* thereof engaged with an engaging hole 24*a* formed in one end face of the control element 24 and another end 32c thereof fitted through a radial retaining groove 9b formed in the projected end face of the hub 9a and into an axial groove 9c continuous with the groove 9b at an inner end thereof such that the another end 32c is clamped between the inner wall surface of the rear head 3 and the opposed end face of the hub 9a. With such arrangement, the coiled spring 32 is securely retained in place at its ends 32b and 32c so that there is no possibility that the coiled spring 32 is dislocated, thus preventing the loops 32a from being brought into contact with the outer peripheral surface of the hub 9a.

Arranged across the low-pressure and high-pressure communication passages 28, 29 is a control valve device 33 for selectively closing and opening them. The control valve device 33 is operable in response to pressure within the suction chamber 17 or low-pressure chamber, and it comprises a bellows 34, a spool valve body 35, and a coiled spring 36 urging the spool valve body 35 in its closing direction. The bellows 34 is disposed within the suction chamber 17 with its axis extending parallel with that of the rotary shaft 11 for expansion and contraction. When the suction pressure within the suction chamber 17 is above a predetermined value, the bellows 34 is in a contracted state, while when the suction pressure is below the predetermined value, the bellows 34 is in an expanded state. The spool valve body 35 is slidably fitted in a valve bore 37 formed in the rear side block 9 and extending across the low-pressure communication passage 28 and the high-pressure communication passage 29. The spool valve body 35 has an annular groove 38 formed in its outer peripheral surface closer to an end remote from the bellows 34, and has a thinned end portion 39 with a small diameter substantially equal to the inner diameter of the annular groove 38 at a location closer to the bellows 34. The spool valve body 35 also has an axial internal passage 40 formed therethrough along its axis. The coiled spring 36 is interposed between a seating surface 35a formed in an end face of the spool valve body 35 remote from the bellows 34 and an opposed end face of the valve bore 37. The other end face of the spool valve body 35 is in urging contact with an opposed end face of the bellows 34. When the pressure within the suction chamber 17 is above the predetermined value and the bellows 34 is contracted, the annular groove 38 of the spool valve body 35 is aligned with the high-pressure communication passage 29 to open the passage 29, and at the same time the low-pressure communication passage 28 is blocked by the peripheral wall of the spool valve body 35. When the pressure within the suction chamber 17 is less than the predetermined value and the bellows 34 is expanded, the high-pressure communication passage 29 is blocked by the peripheral wall of the spool valve body 35, and at the same time the low-pressure communication passage 28 is aligned with the thinned portion 39 of the spool valve body 35 to open the low-pressure communication passage 28. The pressure within the suction chamber 17 acts on the end face of the spool valve body 35 close to the coiled spring 36 by way of the passage 40, as well as on the other end face of the spool valve body 35. Therefore, the spool valve body 35 is only subject to sliding friction during the displacement thereof, thereby undergoing a very small hysteresis between the time of movement in one direction and that in the opposite direction. Further, the spool valve body 35 and the bellows 34 are separably in contact with each other, there being no fear of breakage of them due to vibration or the like.

As shown in FIG. 2, a discharge pressure chamber section 50 is defined at a lower portion of the compressor between the rear head 3 and the rear side block 9. The discharge pressure chamber section 50 has an oil sump 50a located at its bottom portion and accommodating oil, and a pressure-introducing portion 50b located at an upper portion into which discharge pressure is introduced. An oil supply pipe 41 extends radially obliquely in a lower portion of the rear side block 9 between the oil sump 50a and the bearing 12a, 12b section so that oil within the former is supplied to the latter.

FIG. 9 shows an essential part of the vane compressor according to a first embodiment of the invention. A projection 24a is formed on a base portion of one of the pressure receiving portions 26 of the control element 24 in a manner radially inwardly projecting from a radially inner end face of the base portion. The control element 24 is received within the annular recess 22 of the rear side block 9 such that the projection 24a is held in contact with the outer peripheral surface of the hub 9a of the rear side block 9 at an end thereof close to the rotor 10 by the biasing force of the coiled spring 32. With such arrangement, the control element 24 is radially positioned in place due to the contact of the projection 24a with the hub 9a of the rear side block 9. With the control element 24 thus received within the annular recess 22, a clearance X1 of 15–50 microns is provided between the outer peripheral surface of the hub 9a and the inner peripheral surface of the control element 24, and a clearance X2 of 60–120 microns between the inner peripheral surface of the rear side block 9 and the outer peripheral surface of the control element 24. Thus, the control element 24 is radially positioned in place within the annular recess 22 of the rear side block 9 with reference to a radially inner portion of the element 24. A gap is also provided between a central bore 24b axially formed through the control element 24 and the rotary shaft 11.

Alternatively of the illustrated arrangement, the projection 24a may be provided at a radially inner portion of an end face of the control element 24 close to the rear side block 9 other than the base portion of the pressure-receiving portion 26.

Incidentally, the sealing member 31 is omitted in FIG. 9, which seals the gap between the inner wall surface of the annular recess 22 of the rear side block 9 and the outer surface of the control element 24 in an airtight manner, as described before.

The operation of the vane compressor according to the invention constructed as above will now be explained.

As the rotary shaft 11 is rotatively driven by a prime mover such as an automotive engine to cause clockwise rotation of the rotor 10 as viewed in FIG. 3, the rotor 10 rotates so that the vanes $15_1$–155 successively move radially out of the respective slits 14 due to a centrifugal force and back pressure acting upon the vanes and revolve together with the rotating rotor 10, with their tips in sliding contact with the inner peripheral surface of the cam ring 7. During the section stroke each compression chamber 13 defined by adjacent vanes increases in volume so that refrigerant gas as thermal medium is drawn through the refrigerant inlet port 16 into the compression chamber 13; during the following compression stroke the compression chamber 13 decreases in volume to cause the drawn refrigerant gas to be compressed; and during the discharge stroke following the compression stroke the high pressure of the compressed gas forces the discharges valve 20 to open to allow the compressed refrigerant gas to be discharged through the refrigerant outlet port 18 into the discharge pressure chamber 19 and then discharged throught the discharge port 4 into a heat exchange circuit of an associated air conditioning system, not shown.

During the operation of the compressor described above, low pressure or suction pressure within the suction chamber 17 is introduced into the first pressure chamber $27_1$ of each space 27 through the refrigerant inlet port 16, whereas high pressure or discharge pressure within the discharge pressure chamber 19 is introduced into the second pressure chamber $27_2$ of each space 27 through the high-pressure communication passage 29 or through both the high-pressure communication passage 29 and the communication passage 30. The control element 24 is circumferentially displaced depending upon the difference between the sum of the pressure within the first pressure chamber $27_1$ and the biasing force of the coiled spring 32 (which acts upon the control element 24 in the direction of the opening angle of each second inlet port 23 being increased, i.e. in the counter-clockwise direction as viewed in FIG. 4) and the pressure within the second pressure chamber $27_2$ (which acts upon the control element 24 in the direction of the above opening angle being decreased, i.e. in the clockwise direction as viewed in FIG. 4), to vary the opening angle of each second inlet port 23 and accordingly vary the timing of commencement of the compression stroke and hence the delivery quantity.

Figure 7:
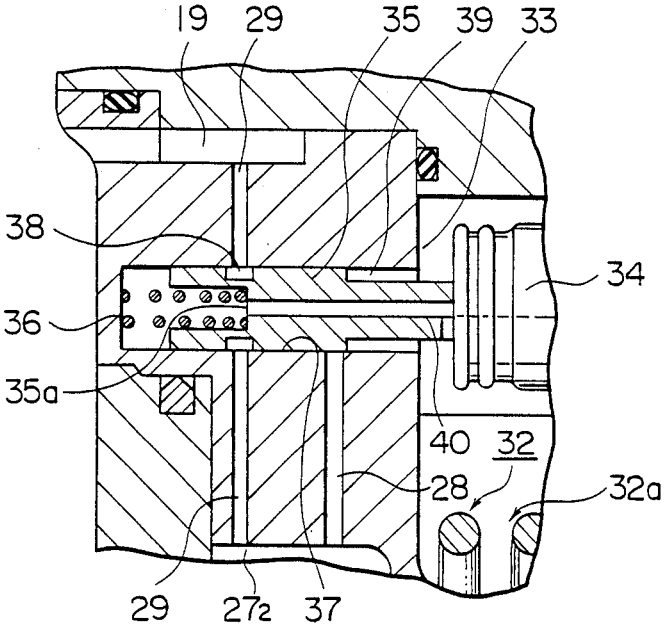
FIG. 7 is an enlarged longitudinal cross-sectional view of a control valve device in a position assumed when the vane compressor of FIG. 2 is at full capacity operation.

For instance, when the compressor is operating at a low speed, the refrigerant gas pressure or suction pressure within the suction chamber 17 is so high that the bellows 34 of the control valve device 33 is contracted to bias the spool valve body 35 to open the high-pressure communication passage 29 and simultaneously block the low-pressure communication passage 28, as shown in FIG. 7. Accordingly, the pressure within the discharge pressure chamber 19 is introduced into the second pressure chamber $27_2$. Consequently, the pressure within the second pressure chamber $27_2$ surpasses the sum of the pressure within the first pressure chamber $27_1$ and the biasing force of the coiled spring 32 so that the control element 24 is circumferentially displaced into an extreme position in the clockwise direction as viewed in FIG. 4, whereby the second inlet ports 23, 23 are fully closed by the control element 24 as indicated by the two-dot chain lines in FIG. 4 (the opening angle is zero). Consequently, all the refrigerant gas drawn through the refrigerant inlet port 16 into the compression chamber 13*a* on the suction stroke is compressed and discharged, resulting in the maximum delivery quantity (Full Capacity Operation).

Figure 8:
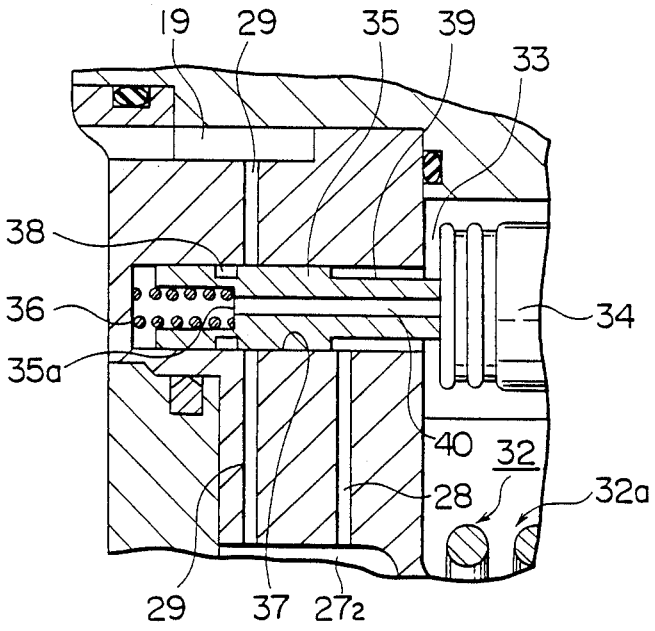
FIG. 8 is a view similar to FIG. 7, wherein the control valve device is in a position assumed when the vane compressor of FIG. 2 is at partial capacity operation.

On the other hand, when the compressor is brought into high speed operation, the suction pressure within the suction chamber 17 is so low that the bellows 34 of the control valve 33 is expanded to urgingly bias the spool valve body 35 against the urging force of the spring 36 to open the low-pressure communication passage 28 and simultaneously block the high-pressure communication passage 29, as shown in FIG. 8. Accordingly, no pressure within the discharge pressure chamber 19 is introduced into the second pressure chamber $27_2$, and at the same time the pressure within the second pressure chamber $27_2$ leaks through the low-pressure communication passage 28 into the suction chamber 17 in which low or suction pressure prevails to cause a prompt drop in the pressure within the second pressure chamber $27_2$. As a result, the control element 24 is promptly angularly or circumferentially displaced in the counter-clockwise direction as viewed in FIG. 4. When the cut-out portions 25, 25 of the control element 24 thus become aligned with the respective second inlet ports 23, 23 to open the latter, as indicated by the solid lines in FIG. 4, refrigerant gas in the suction chamber 17 is drawn into the compression chambers 13*a* not only through the refrigerant inlet ports 16, 16 but also through the second inlet ports 23, 23. Therefore, the timing of commencement of the compression stroke is retarded by an amount corresponding to the degree of opening of the second inlet ports 23, 23 so that the compression stroke period is reduced, resulting in a reduced amount of refrigerant gas that is compressed and hence a reduced delivery quantity (Partial Capacity Operation).

Since as stated before the control element 24 is received within the annular recess 22 of the rear side block 9 and positioned in place by the force of the coiled spring 32 in such a manner such that the projection 24*a* of the control element 24 is held in contact with the outer peripheral surface of the hub 9*a* of the rear side block 9, that is, the control element 24 is radially positioned in place with reference to the radially inward portion thereof, as shown in FIG. 9, the arm or radial distance between the diametrical center or axis of the control element 24 and a point where the projection 24*a* of the control element 24 is in contact with the inner peripheral surface of the annular recess 22 of the rear side block 9 to thereby cause a frictional force, is short, and hence frictional torque acting upon the control element 24 is small, which is caused by the contact of the control element 24 with the rear side block 9, thereby relieving the hysteresis between angular displacement of the control element 24 in one circumferential direction and that in the opposite direction, hence improving the controllability of the capacity of the compressor.

Further, in the vane compressor described above, since the coiled spring 32 is securely retained in place at both ends 32*b*, 32*c* thereof, the spring 32 is prevented from being dislocated from its proper position with its loop 32*a* brought into contact with the outer peripheral surface of the hub 9*a* of the rear side block 9. Further, the secure retention of the coiled spring 32 also relieves the hysteresis between angular displacement of the control element 24 in one circumferential direction and that in opposite direction, which is caused by contacting of the loops 32*a* with each other.

Figure 10:
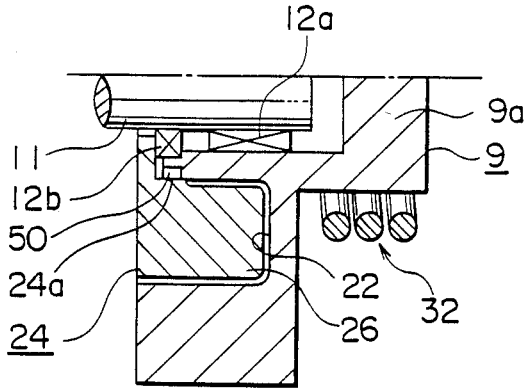
FIG. 10 is a view similar to FIG. 9, showing a second embodiment according to the present invention.

A second embodiment of the invention will now be described with reference to FIG. 10. FIG. 10 is a view similar to FIG. 9, wherein an upper half of the rear side block 9, the control element 24, etc. is omitted.

The second embodiment is distinguished from the first embodiment only in that a bush 50 formed of brass, for example, is press fitted on the outer peripheral surface of the hub 9*a* of the rear side block 9 at an end of the hub 9*a* close to the rotor 10, with which the projection 24*a* of the control element 24 is held in contact. The control element 24 has a prolonged life, as compared with the first embodiment, by virtue of the intervention of the bush 50 between the projection 24*a* of the control element 24 and the outer peripheral surface of the hub 9*a*.

Figure 11:
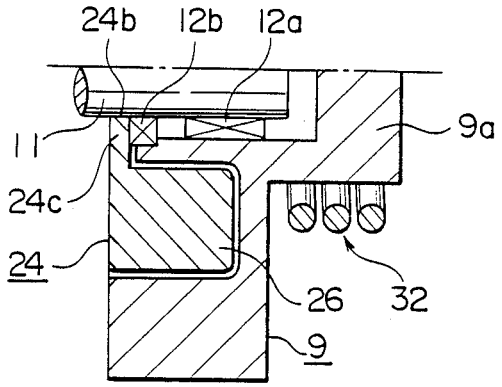
FIG. 11 is a view similar to FIG. 9, showing a third embodiment according to the present invention.

Reference is now made to FIG. 11 showing a third embodiment of the invention.

The third embodiment is distinguished from the first embodiment only in that the central bore 24*b* of the control element 24 has a reduced diameter portion and the control element 24 is received within the annular recess 22 of the rear side block 9 such that reduced diameter portion of the central bore 24b is held in contact with the outer peripheral surface of the rotary shaft 11 by the biasing force of the coiled spring 32, thereby being positioned in place within the annular recess by the contact of the reduced diameter part the central bore 24b of the control element 24 with the rotary shaft 11.

To be specific, a projection 24c forming said reduced diameter portion is formed integrally on the inner peripheral surface of the central bore 24b as the radially inner portion, through which the control element 24 is held in contact with the rotary shaft 11 by the biasing force of the coiled spring 32, whereby the control element 24 is radially positioned in place within the annular recess 22 of the rear side block 9 with reference to the above point of contact. With such arrangement, the arm or radial distance between the diametrical center or axis of the control element 24 and a point where the control element 24 is in contact with the rotary shaft 11 to cause a frictional force, is further shortened as compared with the first embodiment described before. Therefore, the friction torque acting on the control element 24 is considerably reduced as compared with the first embodiment to thereby relieve the hysteresis between angular displacement of the control element 24 in one circumferential direction and that in the opposite direction, thus further enhancing the controllability of the capacity of the compressor.

Incidentally, in the third embodiment, if an oilless bearing is interposed between the central bore 24b of the control element 24 and the rotary shaft 11, the controllability of the capacity of the compressor is further improved.

Figure 12:
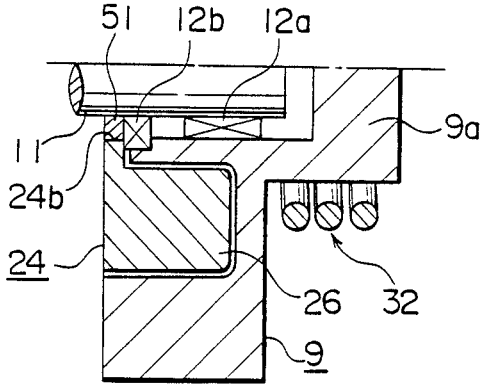
FIG. 12 is a view similar to FIG. 9, showing a fourth embodiment according to the present invention.

FIG. 12 shows a fourth embodiment of the invention.

The fourth embodiment is distinguished from the third embodiment only in that a bush 51 formed of brass, for example, is securely press fitted into the central bore 24b of the control element 24 in such a manner that the bush 51 has its inner peripheral surface in contact with the rotary shaft 11. The control element 24 has a further prolonged life due to the bush 51 interposed between the central bore 24b of the control element 24 and the rotary shaft 11.

Figure 13:
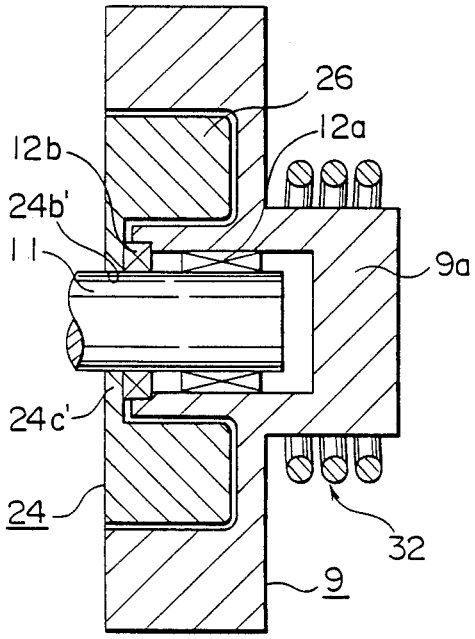
FIG. 13 is a view similar to FIG. 9, showing a fifth embodiment according to the present invention.

FIG. 13 through FIG. 15 show a fifth embodiment of the invention.

The fifth embodiment is distinguished from the aforedescribed fourth embodiment only in that an annular projection 24c' as positioning means is provided on the control element 24 in place of the projection 24c extending along part of the whole circumference thereof, and a lubricating oil groove is provided in the inner peripheral surface of a central bore 24b' of the control element 24 which is slidably fitted on the rotary shaft 11.

The central bore 24b', which is formed by the annular projection 24c', has an inner diameter slightly larger than the outer diameter of the rotary shaft 11, as hereinafter described. The control element 24 is received within the annular recess 22 of the rear side block 9 such that the annular projection 24c' is held in contact with the outer peripheral surface of the rotary shaft 11 with the maximum clearance X3 of 40 to 65 microns (in FIG. 11, the clearance X3 is exaggeratedly illustrated). If the maximum clearance X3 is larger than 65 microns, it is difficult to position the control element 24 in place on the rotary shaft 11. On the other hand, if the maximum clearance X3 is smaller than 40 microns, the control element 24 cannot smoothly rotate. When the maximum clearance X3 falls within the range from 40 to 65 microns, a proper oil film is formed between the control element 24 and the rotary shaft 11, thereby preventing seizure therebetween. Therefore, the maximum clearance X3 has been limited within the range from 40 to 65 microns.

An oil groove $24_2$ is spirally formed in the inner periperal surface of the central bore 24b', which has one end thereof opening in an end face of the control element 24 remote from the rotor 10 and the other end thereof opening in the other end of the control element 24 close to the rotor 10, and extends in a right-hand thread manner. The spiral oil groove $24_2$ serves to allow oil in the bearing 12a, 12b section, which has been supplied from the oil sump 50a through the oil supply pipe 41, to pass therethrough into a gap between the control element 24 and the rotor 10, while adequately lubricating the inner peripheral surface of the central bore 24b'and the outer peripheral surface of the rotary shaft 11 to thereby ensure smooth rotation of the control element 24. In the illustrated embodiment, only one spiral oil groove is shown, but a plurality of spiral oil grooves may be provided.

Following formation of the spiral oil groove $24_2$, the inner peripheral surface of the central bore 24b' is subjected to induction hardening to obtain a hardened surface layer having a depth of approximately 1 mm, thereby improving the wear resistance and preventing seizure between the rotary shaft 11 and the control element 24.

The central bore 24b'has opposite peripheral end edges thereof subjected to spot facing for removal of burrs, to prevent the peripheral end edges from biting the outer peripheral surface of the rotary shaft 11, which would be caused by sharp peripheral end edges of the control bore 24b'. The spot facing also facilitates grinding the inner peripheral surface of the central bore 24b' after being hardened.

According to the fifth embodiment constructed as above, similarly to the embodiments previously described, frictional torque acting upon the control element 24 due to the contact with the rear side block 9 is so small that the hysteresis in angular displacement of the control element 24 is suppressed, thereby improving the controllability of the compressor.

Further, by virtue of the provision of the spiral oil groove $24_2$ in the inner peripheral surface of the central bore 24b', rotation of the rotary shaft 11 causes lubricating oil supplied from the oil sump 50a via oil supply pipe 41 to be guided through the spiral oil groove $24_2$ into the gap between the control element 24 and the rotor 10 to adequately lubricate between the control element 24 and the rotary shaft 11 also between the control element 24 and the rotor 10. Thus, the spiral oil groove $24_2$ also contributes to further reduction of the frictional torque on the control element 24 and hence further suppression of the hysteresis in angular displacement of the control element 24.

FIG. 16 to FIG. 18 shows a sixth embodiment of the invention.

The sixth embodiment is distinguished from the fifth embodiment only in that a central bore $24_3$ having a little larger diameter than the central bore 24b' is formed in the control element 24, and an annular bush 51' formed of an Fe-based sintered alloy (Fe: 95–96%, Cu: 5–4%) for example, is press fitted into the central bore $24_3$ so that the control element 24 is fitted on the rotary shaft 11 in such a manner that the annular bush 51' has its inner peripheral surface in contact with the rotary shaft 11. The control element 24 has a further prolonged life due to the annular bush 51' interposed between the central bore 24b' of the control element 24 and the rotary shaft 11.

In addition, since in the conventional compressor, the control element is radially positioned in place within the annular recess of the rear side block with reference to the outer peripheral surface thereof, there was a problem that when the control element, which is formed of a ferrous material having a high carbon content, for example, is assembled with close tolerances of e.g. 10 to 20 microns into the rear side block, which is formed of an aluminum alloy by die casting, the outer peripheral edge of the former possibly strikes the inner periperal surface of the latter to damage or deform the rear side block.

However, according to the present invention, the control element 24 is radially positioned in place with reference to the inner peripheral surface of the central bore 24b' on the rotary shaft 11 within the radially inner annular recess 22 of the rear side block 9. Therefore, there is almost no possibility of striking and hence damage to or deformation of the inner peripheral surface of the rear side block 9.

Further, since the central bore 24b' is formed through a central portion of the control element 24, which is located at a side of said plate member closer to the rotor than said pressure-receiving protuberances 26 projected in a direction away from the rotor, the axial length of the central bore 24b' is very short, and accordingly the frictional resistance between the control element 24 and the rotary shaft 11 is very small, thus also contributing to reduction of the hysteresis.

Incidentally, the present invention is also applicable to a compressor of the type that the housing 1 is omitted, as disclosed in U.S. Pat. No. 4,766,770 assigned to the assignee of the present application, wherein recesses into which refrigerant outlet ports open are formed in the outer peripheral surface of the cam ring 7, covers are mounted on the cam ring 7 so as to cover the respective recesses such that spaces are formed between the cam ring 7 and the covers in which the discharge valves are arranged, and communicating passages are formed in the cam ring 7 and the side block to communicate the spaces with the discharge pressure chamber 19.

What is claimed is:

1. A variable capacity vane compressor comprising:

a cylinder formed of a cam ring and a pair of front and rear side blocks closing opposite ends of said cam ring, one of said front and rear side blocks having at least one first inlet port and an annular recess formed therein;

a rotor rotatably received within said cylinder;

a plurality of vanes radially slidably fitted in respective slits formed in said rotor;

a housing defining a suction chamber and a discharge pressure chamber therein;

wherein compression chambers are defined between said cylinder, said rotor and adjacent ones of said vanes vary in volume with rotation of said rotor for effecting suction of a compression medium from said suction chamber into said compression chambers through said at least one first inlet port, and compression and discharge of said compression medium;

at least one second inlet port formed in said one of said front and rear side blocks which has said at least one first inlet port formed therein, said at least one second inlet port being located adjacent a corresponding one of said at least one first inlet port, and communicating said suction chamber with at least one of said compression chambers which is on a suction stroke;

a pressure chamber formed in said one of said front and rear side blocks, and communicating with a zone under lower pressure and a zone under higher pressure;

an annular control element angularly displaceably received within said annular recess of said one of said front and rear side blocks;

said control element having a pressure receiving portion slidably received within said pressure chamber and dividing said pressure chamber into a first pressure chamber communicating with said zone under low pressure and a second pressure chamber communicating with said zone under high pressure;

biasing means engaging with said control element and urging same in a direction of increasing the opening angle of said at least one second inlet port;

said control means being angularly displaceable in response to a difference in pressure between said first and second pressure chambers and the biasing force of said biasing means to vary the opening angle of said at least one second inlet port, to thereby cause a change in the timing of commencement of the compression of said compression medium and hence vary the capacity of said compressor;

positioning means provided at a radially inner portion of said control element and radially supporting said control element at the whole circumference thereof to radially position said control element in place within said annular recess of the one of the front and rear side blocks with reference to said radially inner portion of said control element;

a rotary shaft extending through said rotor along an axis thereof for rotatively driving same;

said control element having a central bore formed therethrough and fitted on said rotary shaft;

said positioning means comprising an annular projection formed on an inner peripheral surface of said central bore and held in contact with said rotary shaft; and at least one oil groove formed in said inner peripheral surface of said central bore, said at least one oil groove having one end thereof opening in an end face of said control element and the other end thereof opening in the other end face of said control element.

2. A variable capacity vane compressor as claimed in claim 1, wherein said at least one oil groove spirally extends in said inner peripheral surface of said central bore.

3. A variable capacity vane compressor as claimed in claim 1, wherein said central bore of said control element has opposite peripheral end edges thereof subjected to spot facing.

4. A variable capacity vane compressor as claimed in claim 1, wherein said at least one oil groove extends in a right-hand thread manner.

5. A variable capacity vane compressor as claimed in claim 1, wherein said central bore of said conterol element is slightly larger in diameter than said rotary shaft, and said control element is positioned in place on said rotary shaft with the maximum clearance within a range of from 40 to 65 microns being present between said inner peripheral surface of said central bore and an outer peripheral surface of said rotary shaft.

6. A variable capacity vane compressor as claimed in claim 1, wherein said inner peripheral surface of said central bore is subjected to hardening.

7. A variable capacity vane compressor as claimed in claim 1, wherein said positioning means comprises an annular bush press fitted into said inner peripheral surface of said central bore.

8. A variable capacity vane compressor as claimed in claim 7, wherein said bush is formed of an Fe-based sintered alloy containing copper.

9. A variable capacity vane compressor as claimed in claim 1, wherein said control element comprises a plate member having at least one pressure-receiving portion projected in a direction away from said rotor, said plate member having a central portion having said central bore formed therethrough, said central portion being located at a side of said plate member close to said rotor than said pressure-receiving portion.

10. A variable capacity vane compressor comprising:

a cylinder formed of a cam ring and a pair of front and rear side blocks closing opposite ends of said cam ring, one of said front and rear side blocks having at least one first inlet port and an annular recess formed therein;

a rotor rotatably received within said cylinder;

a plurality of vanes radially slidably fitted in respective slits formed in said rotor;

a housing defining a suction chamber and a discharge pressure chamber therein;

wherein compression chambers are defined between said cylinder, said rotor and adjacent ones of said vanes vary in volume with rotation of said rotor for effecting suction of a compression medium from said suction chamber into said compression chambers through said at least one first inlet port, and compression and discharge of said compression medium;

at least one second inlet port formed in said one of said front and rear side blocks which has said at least one first inlet port formed therein, said at least one second inlet port being located adjacent a corresponding one of said at least one first inlet port, and communicating said suction chamber with at least one of said compression chambers which is on a suction stroke;

a pressure chamber formed in said one of said front and rear side blocks, and communicating with a zone under lower pressure and a zone under higher pressure;

an annular control element angularly displaceably received within said annular recess of said one of said front and rear side blocks;

said control element having a pressure receiving portion slidably received within said pressure chamber and dividing said pressure chamber into a first pressure chamber communicating with said zone under low pressure and a second pressure chamber communicating with said zone under high pressure;

biasing means engaging with said control element and urging same in a direction of increasing the opening angle of said at least one second inlet port;

said control means being angularly displaceable in response to a difference in pressure between said first and second pressure chambers and the biasing force of said biasing means to vary the opening angle of said at least one second inlet port, to thereby cause a change in the timing of commencement of the compression of said compression medium and hence vary the capacity of said compressor;

positioning means provided at a radially inner portion of said control element and radially supporting said control element at the whole circumference thereof to radially position said control element in place within said annular recess of the one of the front and rear side blocks with reference to said radially inner portion of said control element;

a rotary shaft extending through said rotor along an axis thereof for rotatively driving same;

said control element having a central bore formed therethrough and fitted on said rotary shaft; and said positioning means comprising an annular projection formed on an inner peripheral surface of said central bore and held in contact with said rotary shaft.

* * * * *